United States Patent [19]

Borrelli et al.

[11] 4,275,141

[45] Jun. 23, 1981

[54] POLYCRYSTALLINE TIN OXIDE-SILVER CHLORIDE-CADMIUM CHLORIDE UV PHOTOSENSITIVE FILM AND METHOD OF USE

[75] Inventors: Nicholas F. Borrelli, Elmira; Peter L. Young, Painted Post, both of N.Y.

[73] Assignee: Corning Glass Works, Corning, N.Y.

[21] Appl. No.: 86,690

[22] Filed: Oct. 22, 1979

[51] Int. Cl.[3] ..... G03C 1/03; G03C 1/06

[52] U.S. Cl. ..... 430/270; 430/330; 430/495; 430/564; 430/616; 430/932; 430/945; 430/604; 430/14

[58] Field of Search ..... 428/195, 432; 430/604, 430/932, 935, 495, 362, 270, 330, 564, 616

[56] References Cited

U.S. PATENT DOCUMENTS

| | | | |
|---|---|---|---|
| T966,003 | 1/1978 | Maskasky . | |
| 2,945,771 | 7/1960 | Mansfeld | 430/935 X |
| 3,219,448 | 11/1965 | Lu Valle et al. | 430/935 X |
| 3,219,452 | 11/1965 | Hartouni | 430/604 |
| 3,368,895 | 2/1968 | Matejec et al. | 430/255 |
| 3,512,869 | 5/1970 | Plumat et al. | 65/DIG. 2 |
| 3,658,540 | 4/1972 | Malinowski | 430/495 |
| 3,875,321 | 4/1975 | Gliemeroth et al. | 428/432 |

FOREIGN PATENT DOCUMENTS 2236196 1/1975 France .

OTHER PUBLICATIONS

Perveyev et al., Sov. J. Opt. Tech., Feb. 1972, pp. 117–118.

Shepp et al., Phot. Sci. Eng. 11(5), pp. 316–321 1967.

*Primary Examiner*—John D. Welsh

*Attorney, Agent, or Firm*—Kees van der Sterre; Clinton S. Janes, Jr.

[57] ABSTRACT

An ultraviolet-sensitive optical information recording material comprising doped silver chloride and tin oxide which exhibits high ultraviolet darkening sensitivity and good resistance to darkening or bleaching by visible light, and a method for optically recording information in permanent, optically-readable form in such a material by direct writing without chemical development, are described.

5 Claims, No Drawings

POLYCRYSTALLINE TIN OXIDE-SILVER CHLORIDE-CADMIUM CHLORIDE UV PHOTOSENSITIVE FILM AND METHOD OF USE

BACKGROUND OF THE INVENTION

The present invention relates to optical information storage media and particularly to thin silver halide-containing films in which information can be optically stored in permanent fashion using ultraviolet light and without any requirement for image development.

The films incorporated in the present media are related in composition to the films described in our concurrently filed co-pending patent application, Ser. No. 086,829, disclosing electron beam sensitive films for optical mask fabrication or the like.

The use of evaporated binder-free silver halide layers as photographic media has long been known. A good summary of the patent literature in this field is found in the U.S. Defensive Publication of Maskasky, T966,003 of Jan. 3, 1978. U.S. Pat. Nos. 2,945,771 to Mansfeld and 3,219,448 to LuValle et al. describe methods by which such films may be deposited on substrates such as glass or plastic, while a detailed discussion of the deposition, processing and performance of evaporated silver bromide films is provided by A. Shepp et al. in "Evaporated Silver Bromide as a Photographic Recording Medium", *Photographic Science and Engineering*, 11, (5), pp. 316–321 (1967).

U.S. Pat. Nos. 3,219,452 to Hartouni, 3,368,895 to Matejic et al., and 3,658,540 to Malinowski describe materials and/or methods which have been employed to sensitize such photographic films, in order to enhance the latent image formation or chemical developability thereof. In general, binder-free photographic films of the kind described in the above-cited literature are adapted for use in a conventional photographic mode, i.e., a mode wherein the steps of latent image formation by exposure to light and image development by chemical means are required to provide an image of suitable optical density.

Binder-free silver halide based compositions have also been employed in photochromic films, which are films typically exhibiting the properties of visible darkening on exposure to actinic radiation (e.g., short wavelength visible or ultraviolet light) and fading to the original state in the absence thereof. U.S. Pat. No. 3,512,869 to Plumat et al. describes photochromic films incorporating evaporated silver halides or the halides of other metals, which films darken in sunlight and fade in darkness. These films may be catalyzed with copper, cadmium or nickel halides to make them more sensitive to yellow or red visible light, if desired. U.S. Pat. No. 3,875,321 to Gliemeroth and French Pat. No. 2,236,196 are additional patents disclosing reversibly darkenable photochromic films, while in the *Soviet Journal of Optical Technology*, pp. 117–118 (February 1972), A. F. Perveyev et al. describe AgCl-CuCl photochromic coatings.

Generally, rapid darkening in the presence of light and fast fading in the absence thereof are the properties most desired in photochromic films. Hence such films are not suitable optical information storage media because they do not provide a permanent record of the darkening or fading processes.

A photosensitive film which could exhibit efficient, irreversible darkening at low darkening energy levels without any need for chemical development could be advantageously employed as a digital optical memory material, or as a microfilm medium for direct image recording. Good resolution could be provided if such a film could be made to exhibit acceptable contrast at low film thicknesses, and high signal-to-noise ratios could be obtained if a reading wavelength different from the recording wavelength existed for for the film at which it would be highly insensitive to optical alteration by the reading light.

SUMMARY OF THE INVENTION

The present invention is founded upon the discovery of a family of silver chloride-containing materials which are efficiently darkened by exposure to ultraviolet light, and which are relatively insensitive to bleaching or darkening by visible light. The darkening induced by ultraviolet exposure is quite stable, and the optical density levels which can be induced by darkening at moderate exposure levels is sufficient to provide good contrast even in relatively thin films of these materials.

In a first aspect, the invention comprises an ultraviolet-sensitive optical information recording medium incorporating these materials, comprising a supported silver chloride-containing polycrystalline film having a composition imparting high darkening efficiency. That composition is one comprising a combination of tin oxide and doped silver chloride, the silver chloride being doped with cadmium chloride and, optionally, copper chloride in amounts such that the composition of the doped silver chloride is about 4–20% $CdCl_2$, 0–15% CuCl, and the remainder AgCl by weight. The weight ratio of doped silver chloride to tin oxide in these compositions is in the range of about 5–60, the tin oxide being of the formula $SnO_x$ wherein x is between 1 and 2.

In a second aspect, the invention comprises a method for optically recording information in permanent, optically readable form which comprises the step of exposing to ultraviolet light selected portions of a polycrystalline material, provided, for example, in the form of a thin, supported film as above described. The material consists essentially of a combination of tin oxide and doped silver chloride, the silver chloride being doped with cadmium and, optionally, copper, and the exposure is to ultraviolet light of a wavelength below about 400 nm. Exposure is continued for a time sufficient to darken the selected portions to a level providing an optical contrast ratio of at least about 3 between those portions and the remainder of the material.

By virtue of the high darkening sensitivity of these materials and the high levels of optical density which can be induced therein even in thin film form, their use as an optical recording medium permits the storage of high resolution, high contrast images at writing energy levels readily obtainable with conventional laser sources. These characteristics, in combination with the absence of any requirement for chemical development, make these materials attractive candidates for a number of different optical memory applications.

DETAILED DESCRIPTION

The method of choice for producing polycrystalline films for use in the invention is that of vacuum deposition, preferably by thermal evaporation, although other techniques, such as the deposition of the tin oxide film component by ion beam sputtering, could alternatively be employed. In the case of thermal evaporation, deposition chamber pressures typically range from about $10^{-5}$ to about $10^{-6}$ torr.

The material employed as a film substrate is not critical, and can comprise any rigid or flexible glass or plastic material in sheet form which is or can be made sufficiently inert to the film forming materials so that the substrate will not interact with the film during film deposition or use in a manner which will interfere with the optical sensitivity thereof. Preferably the film substrate is a transparent material such as a transparent plastic or glass sheet.

The source of the silver, copper and cadmium chlorides and tin oxide to be incorporated in the deposited film is not critical. Chemically pure AgCl, $CdCl_2$, CuCl and $SnO_2$ constitute suitable starting materials for deposition by thermal evaporation. The use, in an evaporation boat, of a physical mixture of AgCl, CuCl and $CdCl_2$, wherein CuCl constitutes up to about 15% and $CdCl_2$ about 4–20% by weight, with AgCl constituting the remainder, is a useful method for depositing the doped silver chloride component of the combination film on a substrate by thermal evaporation.

Although $SnO_2$ is the preferred starting material for incorporating evaporated tin oxide into these films, some reduction of tin probably occurs in the course of evaporation and deposition, reducing the oxygen concentration in the deposited oxide. This is thought to occur even under a particularly preferred deposition procedure wherein a slight partial pressure of oxygen (e.g., $3\times10^{-5}$ torr of $O_2$) is maintained in the deposition chamber during $SnO_2$ evaporation. Nevertheless, while the final oxygen concentration has not been exactly determined, it is believed that there are between 1 and 2 atoms of oxygen for each atom of tin in the ultimately deposited film.

Preferred film structures within the scope of the invention are those wherein the tin oxide and cadmium-and-copper-doped silver chloride are concurrently deposited on the substrate, as by simultaneous evaporation, so that the film comprises a mixture of the oxide and the chlorides, having the aforementioned weight ratio of chloride to oxide in the range of 5–60. However, it is also possible to sequentially deposit the doped silver chloride and tin oxide components, for example in alternating thin layers, if desired.

The deposition rates for each of the components used in film formation are not critical. However, we have found that simultaneous deposition employing growth rates of about 0.3–1.2 Å/sec. for the tin oxide component and 6–10 Å/sec. for the $CuCl/CdCl_2/AgCl$ component normally provide satisfactory results.

Preferred thickness values for evaporated films to be used for optical information storage media such as described are in the range of about 0.1–2 microns, although thicker films could also be used. The exact thickness will depend upon the contrast ratio and resolution required for a particular film application. Film contrast may normally be enhanced at the expense of resolution by employing thicker films. In any of these films, the contrast ratio is defined in the conventional manner as the ratio of the optical density of the darkened film to the optical density of the undarkened film.

Although not required, moderate heating of these films during the writing process has been found to enhance writing sensitivity, perhaps by accelerating the rate at which silver is formed during the exposure process. Where such enhanced sensitivity is desired, heating the film to temperatures in the range of about 120°–170° C. during the writing process is a suitable method for achieving such results.

The invention may be further understood by reference to the following illustrative example.

EXAMPLE

A flat substrate consisting of a transparent glass slide is thoroughly cleaned and placed in a vacuum chamber. The slide is positioned over a pair of independently heatable tungsten evaporation boats, one boat containing $SnO_2$ and the other a mixture of AgCl, $CdCl_2$ and CuCl consisting of about 7% $CdCl_2$, 7% CuCl, and 86% AgCl by weight. The spacing between the slide and evaporation boats is about 30 centimeters.

The vacuum chamber is evacuated to a pressure of about $10^{-6}$ torr, and then back-filled with oxygen to a pressure of $3\times10^{-5}$ torr. The evaporation boats are then simultaneously heated to cause the vaporization of their contents, the $SnO_2$-containing boat being heated to a temperature sufficient to cause a tin oxide film growth rate of about 0.7 Å/sec. on the substrate, and the boat containing the chloride mixture to a temperature sufficient to cause a $CdCl_2/CuCl/AgCl$ film growth rate of about 8 Å/sec. on the substrate. The evaporation of these compounds is continued until a composite film having a thickness of about 1.0 microns has been obtained. The boats are then cooled and the slide and vapor-deposited film are removed from the vacuum chamber.

The film thus produced is colorless and transparent in appearance, and it is relatively insensitive to optical bleaching or darkening in the visible wavelength range. Exposure of the film to a focused ½-watt laser emitting light of approximately 450 nm wavelength for a few seconds induces no change in optical density, although the input energy under these conditions is equivalent to about $3\times10^4$ J/cm$^2$.

To test the ultraviolet light recording characteristics of this film, it is heated to a temperature of 150° C. and exposed at this temperature to the focused output of a He-Cd laser operating at 325 nm, the incident laser power being 0.04 mw, the exposure time being 1/400 seconds, and the exposure spot size being about 10 microns. The writing energy under these conditions is about 0.13 J/cm$^2$. This writing energy is sufficient to induce a clearly discernible spot in the film, the contrast ratio between the spot and the film being in excess of 3:1. Thus the spot is directly readable in visible light, and requires no fixing or development for image stabilization or intensification.

Further improvements in the writing sensitivity of this film may be obtained, for example, by applying an antireflection coating of conventional configuration over the film surface. The resolution of the film in either case is expected to be very high, projected to be on the order of 2000–3000 Å.

A film such as above described has utility in the optical memory field. Extremely high packing density could be obtained by writing digital information into the film with the 325 nm line of the He-Cd laser, and if both 325 nm and 440 nm lines are obtainable from a single laser of this type, recording could be accomplished with the shorter wavelength line and non-destructive reading could be accomplished with the longer wavelength line in a single laser system. Since the reading and writing wavelengths are different in this case, a very high signal-to-noise ratio could be obtained.

Another anticipated application for these films is in the field of updatable microfilm, wherein real document images are stored in microphotographic form. Since the present films do not require any fixing or development, information could be added to any portion of the film at any time.

In a conventional microfilm system, part of the light from a He-Cd laser would be used to scan a document to be copied, with the reflected signal being detected and fed back to a modulator which would control writing on the film with the remainder of the light output from the laser. Even at the readily obtainable resolution of 600 lines/mm, these films could be used in the ultra-high resolution (1/96 times reduction) microfilm format. Moreover, the writing sensitivity of these films is such that a full page of information could be copied into the film in a fraction of a second, even with a very low power (1 mw) laser writing source.

Still another application for these films would be as computer output microfilm. In an application of this type, the laser beam is modulated by computer output rather than by feedback from a document scanning beam, with the written image consisting, for example, of an alphanumeric character formed in a $9\times15$ spot matrix format. Assuming a surface laser power of 3 mw, a film sensitivity of 50 $mJ/cm^2$, a spot size of 2.5 microns, and a line length of 132 characters, a printing rate of 3360 character lines/minute could readily be obtained. This printing rate is substantially faster than conventional paper printers, and again no fixing or development would be required prior to storing the written information.

Of course, the above description is merely illustrative of film preparation techniques and optical information storage media which could be provided in accordance with the invention. Numerous variations and modifications of the procedures hereinabove described may be resorted to within the scope of the invention as defined by the appended claims.

We claim:

1. A method for optically recording information in permanent form which comprises the step of exposing selected portions of a polycrystalline material having a composition which consists essentially of tin oxide, silver chloride, cadmium chloride and, optionally, copper chloride to ultraviolet light of a wavelength below 400 nm for a time sufficient to selectively darken said portions to a level providing an optical contrast ratio of at least about 3 between said portions and the unexposed portions of the material.

2. A method in accordance with claim 1 wherein the polycrystalline material is provided in the form of a supported polycrystalline film consisting essentially of a combination of doped silver chloride and tin-oxide, the doped silver chloride consisting of about 4–20% $CdCl_2$, 0–15% CuCl and the remainder AgCl by weight, the tin oxide consisting of $SnO_x$ wherein x is between 1 and 2, and the weight ratio of doped silver chloride to tin oxide being in the range of about 5–60.

3. A method in accordance with claim 2 wherein the polycrystalline film consists essentially of a mixture of $SnO_x$ and doped silver chloride.

4. A method in accordance with claim 2 wherein the polycrystalline film consists essentially of alternating layers of $SnO_x$ and doped silver chloride.

5. A method in accordance with claim 3 wherein the film is maintained at a temperature in the range of about 120°–170° C. during exposure.

* * * * *